United States Patent [19]

Murphy et al.

[11] Patent Number: 4,707,239

[45] Date of Patent: Nov. 17, 1987

[54] ELECTRODE ASSEMBLY FOR MOLTEN METAL PRODUCTION FROM MOLTEN ELECTROLYTES

[75] Inventors: James E. Murphy, Verdi; Michael F. Chambers, Reno, both of Nev.

[73] Assignee: The United States of America as represented by the Secretary of the Interior, Washington, D.C.

[21] Appl. No.: 838,491

[22] Filed: Mar. 11, 1986

[51] Int. Cl.[4] ..... C25C 3/02; C25C 7/02; C25B 11/12; C25B 11/03

[52] U.S. Cl. ..... 204/247; 204/284; 204/294; 204/286; 204/278

[58] Field of Search .... 204/280, 284, 294, 243 R–247, 204/286, 278

[56] References Cited

U.S. PATENT DOCUMENTS

| | | | |
|---|---|---|---|
| 1,545,384 | 7/1925 | Ashcroft | 204/247 X |
| 2,974,098 | 3/1961 | Oliver | 204/294 X |
| 3,855,104 | 12/1974 | Messner | 204/294 X |
| 4,376,690 | 3/1983 | Kugler | 204/243 R |
| 4,608,144 | 8/1986 | Darwent | 204/284 X |
| 4,613,414 | 9/1986 | Sivilotti et al. | 204/284 X |
| 4,622,111 | 11/1986 | Brown et al. | 204/243 R |

*Primary Examiner*—Donald R. Valentine

*Attorney, Agent, or Firm*—E. Philip Koltos; Thomas Zack

[57] ABSTRACT

An improved electrode assembly is disclosed for use in electrolytic cells for producing metal by the electrolysis of a molten-salt electrolyte. The electrode assembly includes at least one anode and cathode disposed within an electrolytic cell in a spaced-relationship to thereby define an inter-electrode space and an effective electrolyte bath area. The parallel, opposed sides of the anode and cathode defining the inter-electrode space of the improved electrode assembly have an offset, sawtooth pattern of triangular peaks and valleys to thereby increase the effective electrode surface area and to facilitate the rapid, effective removal of gas produced during electrolysis from the anode and from the inter-electrode, electrolyte bath area. To further facilitate the removal of such gases, the anode of the present invention includes a uniformly distributed plurality of gas evacuation apertures therethrough.

15 Claims, 3 Drawing Figures

ELECTRODE ASSEMBLY FOR MOLTEN METAL PRODUCTION FROM MOLTEN ELECTROLYTES

TECHNICAL FIELD

The present invention relates in general to electrolytic cells for obtaining metal by electrolysis of a molten salt bath, and, more particularly to an electrode assembly for use in electrolytic cells for obtaining metal by electrolysis in a molten salt bath.

BACKGROUND ART

The use of electrolytic cells for the production of metal by the reduction of a metal halide in a molten salt electrolyte has been known for many years. That the process requires large amounts of electrical energy has been recognized and accepted for almost as many years. The high cost of electrolysis due to high consumption of electrical energy is a problem that has been the subject of much research.

A cell of the well-known type, useful for the production of either zinc or lead by the reduction of the appropriate metal chloride, is described in U.S. Pat. No. 1,545,383 to Ashcroft. The cell includes a group of closely spaced, inclined graphite plates which function as bipolar electrodes arranged in a superimposed, spaced relationship to define inter-electrode spaces. As electrolysis proceeds, metal and chlorine are produced in the inter-electrode spaces. Because of the inclination of the electrodes, the metal produced in the cell flows downwardly across the cathode surfaces of intermediate electrodes, while at the same time, the chlorine produced flows upwardly across the inclined anode surfaces of intermediate electrodes and through holes near the ends thereof to a gas-collecting zone in the top of the cell. The anode and cathode surfaces of the electrodes of this cell may be corrugated or grooved in the direction of the flows of metal and chlorine in the cell. Nonetheless, the chlorine gas must traverse the surface of the anode and, therefore, the length of the intra-electrode electrolyte bath area before it reaches the holes leading to the gas-collecting zone.

This presence and build-up of gas generated during electrolysis has long been recognized as one of the major causes of the large electrical energy requirements of electrolytic cells. For example, U.S. Pat. No. 1,856,663 to Smith describes a multiple electrode for electrolytic apparatus which conducts or directs the generated gases away from the electrolyzing area. The electrode includes interconnected, superposed electrode elements provided with a flat central portion and upwardly pointed angular corrugations or flutings along their electrolyzing edges which, when assembled, form a plurality of vertical central and side passages.

In further attempts to achieve efficient electrolysis by removing generated gases, there have been developed various other designs and arrangements of electrodes for use in electrolytic cells. U.S. Pat. No. 4,151,061 to Ishikawa et al describes a "funnel-shaped" electrode element arrangement formed of at least three vertically stacked electrodes inclined downwardly and inwardly, having a first communicating passage formed in the center and a second communicating passage formed between the outer edge of the electrodes and the inner wall of the cell. Other electrode configurations are disclosed by U.S. Pat. No. 4,401,530 to Clere and U.S. Pat. No. 2,959,533 to de Varda.

It is clear from the above-noted prior art that in order to efficiently electrowin metal from an electrolyte bath in an electrolytic cell, the electrodes must be appropriately designed and positioned. Despite this knowledge, the electrolytic production of lead from an electrolytic bath still requires a consumption of electricity which remains very large and, consequently, the process is very expensive. The problem with the noted known electrolytic cell electrode assemblies is that effective, rapid removal of gas generated during electrolysis is still not achieved nor is the effective electrolyte bath area between the electrodes maximized by maximizing the electrode surface area. Consequently, electrolytic production of metal remains inefficient and costly. Therefore, it would be advantageous if the consumption of electricity could be limited by an efficient and effective electrode assembly. To produce lead efficiently and inexpensively, unlike the electrode designs of the above-cited prior art, the electrode assembly should rapidly and effectively direct the gas produced away from the effective electrolytic bath area between the electrodes, increase both the effective electrolytic bath area and the electrode surface area and permit the metal produced to accumulate in another portion of the cell.

There is a need for an electrode assembly for use in electrolytic cells which enables the efficient, inexpensive production of metal from the appropriate metallic molten salt bath.

DISCLOSURE OF INVENTION

It is a main object of the present invention to provide a novel and improved electrode assembly for use in an electrolytic cell for producing metal by electrolytic reduction of a molten salt bath.

A specific object of the present invention is to provide a novel and improved electrode assembly for use in producing metal, for example, lead, by electrolytic reduction of a mixed chloride electrolyte, for example, a lithium chloride-potassium chloride-lead chloride electrolyte, with minimal electrical energy requirement.

Yet a further object of the present invention is to provide a novel and improved electrode assembly designed to increase the efficiency of producting a metal by electrolysis by decreasing the voltage and energy requirements of molten-salt electrolysis cells thereby reducing the cost of electrolysis.

Another object of the present invention is to provide a novel and improved electrode assembly designed to reduce the voltage and energy required to produce a metal by electrolysis by providing an increased electrode surface area without increasing the overall size of the electrodes used in the assembly.

It is a further object of the present invention to reduce the voltage and energy required to produce a metal by electrolysis by providing an electrode assembly designed to increase the effective interelectrode electrolyte area.

A still further object of the present invention is to reduce the voltage and energy required to produce a metal by electrolysis by providing an electrode assembly designed to facilitate the efficient, rapid removal of gases generated during electrolysis.

These and other objects are achieved by providing an electrode assembly comprising at least one anode and at least one cathode, each having a sawtooth surface comprising a series of rows of triangular peaks and valleys, which surfaces cooperate to define the effective interelectrode electrolyte area.

BEST MODE FOR CARRYING OUT THE INVENTION

For convenience, a preferred embodiment of this invention will be described with reference to a process for producing lead by electrolysis, but the scope of the invention is intended to include use in the production of other metals by electrolysis as well; for example, aluminum or zinc.

Figure 1:
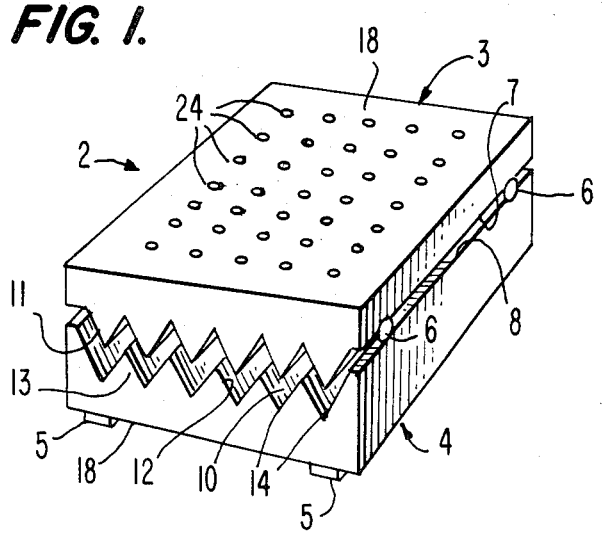
FIG. 1 is a perspective view of the electrode assembly used in the present invention.

In the embodiment shown in FIG. 1, the electrode assembly of the present invention indicated generally at 2, may be employed in an electrolytic cell used for the production of lead by the electrolytic reduction of a mixed lead chloride electrolyte. Electrode assembly 2 includes at least one upper anode electrode forming an anode 3, and at least one lower, cathode electrode forming a cathode 4. In use, the anode 3 and cathode 4 are immersed in an electrolyte bath within a suitable electrolytic cell, and may be disposed in such a cell in a horizontal, parallel and vertically-spaced relationship. Cathode 4 is supported on an interior surface of the cell by graphite blocks 5, while anode 3 is supported on the cathode in parallel, vertically-spaced relationship therewith by heat resistant, insulating anode support members 6. These support members are impervious to the electrolytic bath used in the cell and may be composed of a suitable refractory material. The distance between the electrode surfaces may be variably controlled by using appropriately-sized anode support member 6. The anode 3 and cathode 4, positioned and supported as in FIG. 1, define an inter-electrode space 10.

Figure 2:
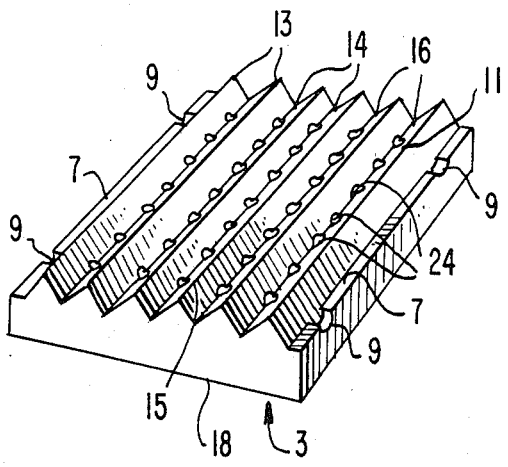
FIG. 2 is a perspective view showing the interelectrode surface of the anode of the electrode assembly shown in FIG. 1.
Figure 3:
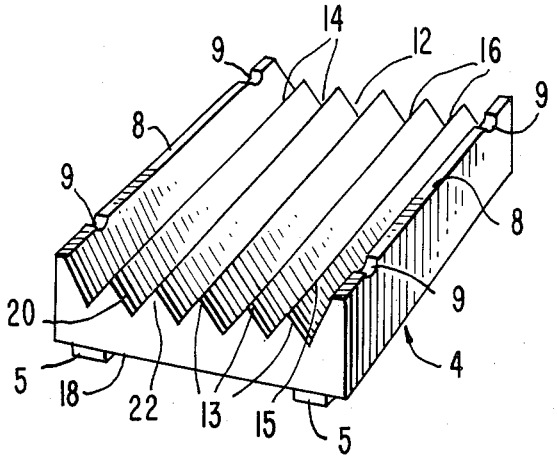
FIG. 3 is a perspective view showing the inter-electrode surface of the cathode of the electrode assembly shown in FIG. 1.

As best shown in FIGS. 2 and 3, the perimeters of the anode 3 and the cathode 4 are provided with support surfaces 7 and 8 respectively which are formed to include appropriately-shaped recessed areas or seats 9 to accommodate said anode support members 6. Between support surfaces 7 and 8, opposed anode surface 11 and cathode surface 12 are formed to provide a cooperating, offset sawtooth pattern comprised of a series of rows of alternating triangular peaks 13 and valleys 14. The sawtooth pattern is formed by making cuts to a considerable depth in anode and cathode surfaces 11 and 12 which define inter-electrode space 10. FIGS. 2 and 3 illustrate that these cuts provide a plurality of substantially parallel, elongated peaks 13 which each terminate in an apex 15 and which are separated by intermediate valleys 14 that each terminate at an apex 16. The depth of a valley 14 at the apex 16 thereof is substantial and the distance to an apex 16 from a plane extending through the apexes 15 should normally be equal to at least one third the distance from an apex 15 to a surface 18 of either the anode or cathode. The surface 18 is opposite to and spaced from either the anode surface 11 or the cathode surface 12.

The angles of the cuts made in the electrode surfaces to form the sawtooth pattern, which are indicated at 20 may be 30° from vertical. The effective bath area depends on inter-electrode space 10 and the size of apex angles 22. At ½ inch interelectrode spacing, the maximum effective bath area is achieved with 60° apex angles. However, the angle 22 of the triangles forming the sawtooth pattern may be less than or greater than 60°. Smaller angles will result in larger increases in the total electrode surface area, comprised of anode surface 11 and cathode surface 12, but to maximize the effective bath area between the electrodes, inter-electrode space 10 must decrease as well.

As shown in FIG. 2, the surface of anode 3 which has a sawtooth pattern, comprises a series of rows of alternating triangular peaks 13 and valleys 14 which form the anode surface 11 thereof. As further shown by FIG. 2, anode 3 is provided with gas evacuation apertures 24 which are arranged at equally-spaced intervals in a linear grid pattern to extend completely through anode 3. The linear arrangement of the apertures is formed to penetrate the anode and to extend along the apex 16 of each sawtooth valley 14. These apertures extend through the anode from the apex 16 to the surface 18.

As shown in FIG. 3, cathode surface 12 which, with anode surface 11 defines the inter-electrode space 10, has a sawtooth pattern comprising a series of rows of alternating triangular peaks 13 and valleys 14. As best shown in FIG. 1, the sawtooth pattern on cathode surface 12 is offset from that of anode surface 11 so that if anode 3 and cathode 4 are placed in superimposed, parallel spaced relationship, the peaks 13 of each anode and cathode electrode extend into the valleys 14 of the opposed electrode. To make certain that the anode and cathode surfaces are properly oriented and aligned, one pair of the support surfaces 7 or 8 is positioned in the plane of the apexes 15 while the remaining support surfaces are positioned in the plane of the apexes 16.

When an electrolytic cell is operated in the usual manner to produce lead, electrolysis takes place in the inter-electrode space 10 and the process produces chlorine gas on anode surface 11 and lead on cathode surface 12. The chlorine gas is channeled by the sloping sides of valleys 12 on anode surface 11 to the gas-evacuation passages 24 and is evacuated from the inter-electrode space 10. Because apertures 24 are at equally-spaced intervals across entire anode surface 11, gas evacuation takes place at frequent intervals spread across the entire anode surface and the gases do not transverse a substantial extent of the inter-electrode space 10 before release.

Suitable electrical terminals (not shown) are connected to the anode and cathode electrodes of the electrode assembly 2 of the present invention, and this assembly reduces the consumption of electrical energy and increases the efficiency of electrolysis. Firstly, the sawtooth pattern of anode surface 11 and cathode surface 12 increases the effective electrolyte bath area in space 10 and the electrode surface area without requiring electrodes of larger size. Secondly, the combination of the sawtooth pattern on anode surface 11 and the provision and location of gas evacuation apertures 24 effect the rapid removal from the inter-electrode space 10 of gases generated during electrolysis. The advantages of use of electrode assembly 2 of the present invention are illustrated by the following examples.

In the following examples, the electrical power, P, supplied to an electrolytic cell for electrowinning metal is given by:

$$P = VI \quad (1)$$

where V is the cell voltage and I is the cell current.

The energy, W, consumed by an electrolytic cell during a period of operation is obtained by multiplying the power input by the time, t:

$$W = Pt = VIt \quad (2)$$

The energy requirement for a cell is the energy consumed divided by the mass of the metal produced:

$$\text{Energy requirement} = \frac{VIt}{\text{Product weight}} \quad (3)$$

Thus, the energy requirement varies linearly with the cell voltage which is given by:

$$V = V_D + N_A + N_C + R_e I + R_m I \quad (4)$$

where $V_D$ is the decomposition potential of the metal compound, $N_A$ is the anode overvoltage, $N_C$ is the cathode overvoltage, $R_e$ is the resistance in the electrode leads and the electrodes, and $R_m$ is the resistance in the electrolyte and I is the cell current.

$V_D$ the decomposition voltage, is a function of the free energy of formation of the metal compound, is constant for the given conditions, and is about 1.4 V for lead chloride. The anode and cathode overvoltages vary with the electrode current densities but should be small (0.1 V) in the case of $PbCl_2$ electrolysis. A small anode overvoltage assumes that any gas generated at anode 3 will be unrestricted in its escape. In the case of lead chloride electrolysis, if chlorine gas produced at the anode does not escape freely, but rather accumulates against anode surface 11, the anodic overvoltage will increase dramatically.

The $R_e I$ voltage term depends on the size of the electrode leads and in a properly designed cell should be on the order of 0.1–0.2 V.

The $R_m I$ voltage is given as follows:

$$R_m I = \frac{IL}{K^* A} \quad (5)$$

where L is the electrode spacing 10, K* is the effective electrolyte conductivity, and A is the effective electrolyte bath area 18 (the electrolyte area between the electrodes). K*, the effective conductivity, is related to the absolute conductivity, K, of the electrolyte as follows:

$$K^* = K(1-E)^{1.5} \quad (6)$$

where E is the gas fraction in the electrolyte.

The prior art for electrowinning lead from lead chloride consisted of using flat, horizontally positioned graphite plates for anode and cathode. In some cells, grooves are cut in the flat anode plate to channel chlorine gas thereacross and toward the ends of the electrodes. The gas fraction in the electrolyte and on the anode would be expected to increase as the anode size increases. In the following examples, a 3,000-A cell, the largest cell used in lead chloride electrowinning, was tested with both a prior art, flat plate electrode assembly and then with the electrode assembly 2 of FIG. 1 of the present invention. The results obtained with known, prior art, flat plate electrodes are presented in example 1 and the results with electrode assembly 2 of the present invention are given in example 2.

EXAMPLE 1

The electrolytic cell for this example was a 3,000-A cell 34 inches long, 25 inches wide, and 18 inches deep. Two graphite plate anodes, 14 inches by 24 inches by 3 inches were threaded and attached to two 6 inch diameter graphite rods which were connected to a busbar. Another graphite plate, 29 inches by 24 inches by 2 inches served as the cathode. The cathode-anode spacing was $\frac{3}{4}$ inch and the surface of the cathode had six $\frac{1}{4}$ inch grooves to direct the lead metal produced to the side of the cell. The cathode plate was supported by four graphite blocks which were immersed in a pool of molten lead metal. A steel bar passed under the molten lead and brought power to the cathode from the rectifier.

The electrolyte contained 77 pct $PbCl_2$, 16.5 pct KCl, and 6.5 pct LiCl. The cell was operated at 450° C. continuously for several 5- and 10-day periods. The average results of the tests are shown in table 1.

TABLE 1

Average operating data for a 3,000-A cell with flat plate electrodes

| | | |
|---|---|---|
| Current | A | 3,000 |
| Voltage | V | 4.7 |
| Electrolyte temperature | °C. | 450 |
| Electrode current density | A/in$^2$ | 4.5 |
| Current efficiency | pct | 93 |
| Ampere-hours consumed | | 3,005,064 |
| Lead produced | lb | 23,655 |
| Energy requirement | kWhr/lb | 0.60 |

The overall cell voltage for the flat plate electrodes was 4.7 V as shown in table 1. In equation 4, the $R_e I$ term, the voltage drop in the electrode leads, was measured as 0.6 V. Assuming anode and cathode over-voltages were about 0.1 V and using 1.4 V for the decomposition potential, $R_m I$ can be solved for by substituting in equation 4:

$$R_m I = 4.7\text{ V} - 1.4\text{ V} - 0.1\text{ V} - 0.1\text{ V} - 0.6\text{ V}$$

$$= 2.5\text{ V}$$

From equation 5, it follows that $$2.5\text{ V} = \frac{3{,}000\ A \times 0.75\text{ in}}{K^*\ (29'' \times 24'')}$$

$$K^* = 1.29\Omega^{-1}\text{ in}^{-1}$$

or $$K^* = 0.51\Omega^{-1}\text{ cm}^{-1}$$

From literature values $$K = 1.165\ \Omega^{-1}\text{ cm}_{-1}$$

Therefore, from equation 6

$$0.51 = 1.165\ (1 - E)^{1.5}$$

$$E = 0.42$$

Providing the assumptions are correct, the chloride gas fraction on the anode was 42 pct of the electrolyte.

EXAMPLE 2

Electrode assembly 2 of the present invention is designed to increase the electrode surface area (anode surface 11 and cathode surface 12) and thereby to increase the effective electrolytic bath area 18. It is further designed to remove more effectively, rapidly and efficiently gas generated during electrolysis from anode surface 11 and inter-electrode space 10 thereby decreasing the anode overpotential. As shown in the Figures, the electrode assembly design, termed a sawtooth electrode design, has triangular shaped peaks 13 and valleys 14 cut in anode surface 11 and cathode surface 12. The cuts are offset so that the sides of alternating triangular peaks and valleys are parallel and the peaks extend substantially into the valleys when the anode 3 and cathode 4 are placed in spaced relationship to define the effective electrolytic bath area 18. Electrode assembly 2 shown in FIG. 1 replaces the flat plate electrode assembly used in the electrolytic method described in example 1. The angles 20 of the cuts in the anode surface 11 and cathode surface 12 may be 30° from vertical making the angles of the triangles 60°. At 60°, the electrode surface area (anode surface 11 and cathode surface 12) is doubled relative to the surface area of a flat electrode surface. The increase in the effective bath area in the inter-electrode space 10 is somewhat less than the increse in the electrode surface area because of some electrolytically inactive space at the apexes 15 of the peaks 13 and at the apexes 16 of the valleys 14. Most importantly, the chlorine gas generated at anode surface 11 as electrolysis proceeds flows to the deepest portion of the valleys 14 on anode surface 11, where ½-inch gas evacuation apertures 15, spaced 3 inches apart, permit the chlorine to escape. With the new sawtooth electrode design, inter-electrode space 10 is decreased to ½ inch. The results obtained in the 3,000-A cell with the sawtooth electrode assembly 2 of the present invention are given in table 2.

TABLE 2

Data for electrowinning lead in a 3,000-A cell with sawtooth electrodes

| | | |
|---|---|---|
| Current | A | 3,000 |
| Voltage | V | 2.5 |
| Electrolyte temperature | °C. | 450 |
| Electrode current density | A/in$^2$ | 2.3 |
| Current efficiency | pct | 99 |
| Ampere-hours consumed | | 426,527 |
| Lead produced | lb | 3,592 |
| Energy requirement | kWhr/lb | 0.30 |

With the sawtooth electrode assembly, the cell voltage was decreased to 2.5 V and the energy requirement was decreased to 0.30 kW·h/lb. Substituting into equation 4

$$R^m I = 2.5\text{ V} - 1.4\text{ V} - 0.1\text{ V} - 0.1\text{ V} - 0.6\text{ V}$$

$$= 0.3\text{ V}$$

Calculating the effective electrolyte conductivity, K* by equation 5 yields a value that is very similar to K, the absolute conductivity. Chlorine gas generated during electrolysis had very little effect on conductivity with the sawtooth electrode assembly. The design efficiently removed chlorine from the anode surface 11 and from the effective electrolyte bath area in the inter-electrode space 10.

It should be understood that additional aspects and objects of the invention may be perceived from further study of the objects, disclosure, examples and appended claims. While the invention has been described in terms of a preferred embodiment and may be subject to various changes and adaptations, the claims appended hereto are intended to encompass within their meaning and scope of equivalents all embodiments within the spirit of the invention.

INDUSTRIAL APPLICABILITY

Molten-salt electrolysis in a mixed chloride electrolyte using the electrode assembly 2 of the present invention will reduce the electrical energy required and thereby will decrease the cost of electrolysis. For electrolytic production of metals using the electrode assembly of the present invention, materials for construction are readily available at low cost and thus capital investment is held down.

Because of the decreased energy requirements brought about by using the electrode assembly of the present invention in the electrolytic production of metals, the potential for widespread industrial use of the electrode assembly of the present invention to improve the efficiency of electrolytic production of metals is great. In large electrolytic cells, many electrode assemblies 2 will be employed in a single cell, and these assemblies will be arranged in a side by side relationship.

What is claimed is:

1. An electrode assembly for use in an electrolytic cell for producing metal comprising:

(a) at least an anode electrode and a cathode electrode, arranged in spaced relationship to define an inter-electrode space between said anode and cathode electrodes;

(i) each said anode and cathode electrode being formed with at least one surface having a pattern comprising a series of rows of alternating peaks and valleys; and (b) means for assembling said anode and cathode electrodes so that the sides of the peaks on one of said anode or cathode electrode surfaces extend into the sides of the valleys on the other electrode surface in parallel spaced relationship wherein said anode electrode is provided with a plurality of spaced gas evacuation apertures extending therethrough, said apertures being positioned in said valleys whereby gas produced during electrolysis may enter the apertures and flow out of said inter-electrode space.

2. The electrode assembly of claim 1 wherein said gas evacuation apertures are arranged with respect to said anode electrode in a linear-grid pattern whereby said apertures penetrate said anode electrode at equally-spaced intervals at discrete points over a substantial portion of said anode electrode surface having a sawtooth pattern.

3. The electrode assembly of claim 2, wherein said discrete points at which said apertures penetrate said anode electrode are equally-spaced along the length of each valley of said anode electrode surface.

4. The electrode assembly of claim 1, wherein said anode electrode surface and said cathode electrode surface have a sawtooth pattern, each including flat support surfaces formed adjacent to the outermost of said rows of peaks and valleys.

5. The electrode assembly of claim 4, wherein said flat support surfaces are provided with areas adapted to receive means for assembling said anode and cathode electrodes to define an inter-electrode space therebetween.

6. The electrode assembly of claim 5, wherein said cathode electrode surface having a sawtooth pattern includes peaks which each terminate at an apex, said support surfaces being formed to extend substantially in the plane of the apex of said peaks.

7. The electrode assembly of claim 6, wherein said anode electrode surface having a sawtooth pattern includes valleys which terminate at an apex, the support surfaces of said anode electrode surface being formed to extend substantially in the plane of the apex of said valleys.

8. The electrode assembly of claim 7, wherein said flat support surfaces are provided with areas adapted to receive means for assembling anode and cathode electrodes to define an inter-electrode space therebetween.

9. The electrode assembly of claim 1 wherein in said rows of peaks and valleys, the angle of said peaks is 60° at ½ inch inter-electrode spacing.

10. An electrode assembly for use in an electrolytic cell for producing metal comprising at least an anode electrode and a cathode electrode arranged in a spaced relationship to define an inter-electrode space between said anode and cathode electrodes;

(i) said anode electrode being formed with at least one anode surface having a pattern comprising a series of rows of alternating peaks and valleys, said anode surface being bounded on two opposed sides by flat support surfaces parallel to said rows of peaks and valleys;

(ii) said cathode electrode being formed with at least one cathode surface having a pattern comprising a series of rows of alternating peaks and valleys, said cathode surface being bounded on two opposed sides by flat support surfaces parallel to said rows of peaks and valley;

(iii) means for assembling said anode and cathode electrodes so that the sides of the peaks on one of said anode or cathode electrode surfaces extend into the sides of the valleys on the other electrode surface in parallel spaced relationship wherein said anode electrode is provided with a plurality of spaced gas evacuation apertures extending therethrough, said apertures being positioned in said valleys whereby gas produced during electrolysis may enter the apertures and flow out of said inter-electrode space.

11. The electrode assembly of claim 10, wherein said alternating peaks and valleys on said anode and said cathode electrode surfaces are comprised of equal size triangular peaks and valleys.

12. The electrode assembly of claim 10, wherein said flat support surfaces include areas adapted to receive said means for assembling said anode and cathode electrodes.

13. The electrode assembly of claim 12, wherein said areas comprise cylindrical depressions adapted to receive said means for assembling said anode and cathode electrodes, said means for assembling said anode and cathode electrodes including a plurality of heat resistant, insulating cylindrical support members formed of a refractory material.

14. An anode electrode for use in an electrode asembly for an electrolytic cell for producing metal in accordance with claim 10 comprising a graphite plate having at least one surface with a pattern including a series of rows of alternating peaks and valleys formed thereon, and an equally-spaced arrangement of gas evacuation apertures extending through said plate forming said valleys.

15. The electrode assembly of claim 1 wherein in said rows of alternating peaks and valleys the apex of said peaks is 60° at ½ inch inter-electrode spacing.

* * * * *